US005924685A

United States Patent [19]

Webb

[11] Patent Number: 5,924,685

[45] Date of Patent: Jul. 20, 1999

[54] ADJUSTABLE CLAMP

[76] Inventor: Robert M. Webb, 14804 Birch Springs Ct., Silver Spring, Md. 20905

[21] Appl. No.: 08/980,278

[22] Filed: Nov. 28, 1997

Related U.S. Application Data

[60] Provisional application No. 60/049,502, Jun. 16, 1997.

[51] Int. Cl.[6] ..... B25B 1/14

[52] U.S. Cl. ..... 269/228; 269/274; 269/275

[58] Field of Search ..... 269/228, 24, 91–95, 269/201, 238, 262, 271

[56] References Cited

U.S. PATENT DOCUMENTS

| | | | |
|---|---|---|---|
| 1,801,222 | 4/1931 | Cayo | 269/93 |
| 2,349,087 | 5/1944 | Fraser | 269/92 |
| 2,501,238 | 3/1950 | Sarsgard et al. | 269/228 |
| 3,700,227 | 10/1972 | Sessody | 269/24 |
| 3,924,844 | 12/1975 | Bachtel, Jr. | 269/94 |
| 4,335,873 | 6/1982 | Kiefer | 269/228 |
| 4,407,493 | 10/1983 | Okolischan | 269/93 |
| 4,470,586 | 9/1984 | Spencer | 269/93 |
| 4,958,813 | 9/1990 | Dykstra | 269/32 |
| 4,981,289 | 1/1991 | Duval | 269/94 |
| 5,080,336 | 1/1992 | Carossino | 269/93 |
| 5,275,391 | 1/1994 | Lynn et al. | 269/93 |
| 5,688,014 | 11/1997 | Kot | 269/228 |

*Primary Examiner*—David A. Scherbel
*Assistant Examiner*—Lee Wilson
*Attorney, Agent, or Firm*—Thomas Zack

[57] ABSTRACT

A work piece stock holding member that can be adjusted by a single handle or adjustment nut usable with a conventional channeled toggle clamp fixed to a working surface. The holding member has an internally and externally threaded collar having a single piece joined clamp engaging unitary washer. The collar's internal threads are received by the external threads of an inserted supporting bolt. An upper end adjustment handle is fixed to the supporting bolt to rotate in unison with the bolt. The vertical adjustment of the holding member relative to the working piece is performed by rotating this bolt's upper handle. On one side of the clamp's channel is another separate holed washer which bears against one side of the clamp, moves on its hole pass the central bolt and bears against an adjustment nut mount on the collar's external upper threads. By tightening or loosening the adjustment nut, the two opposing bolt mounted washers can be moved to permit their engagement or disengagement with the toggle clamp's surfaces. When the single nut is loosened the holding member can be moved horizontally and then tightened to permit the holding member's horizontal adjustment with respect to the holding member's work piece engaging end and the fixed toggle clamp.

14 Claims, 2 Drawing Sheets

ADJUSTABLE CLAMP

This application claims the benefit of the U.S. Provisional application 60/049,502 filed Jun. 16, 1997.

BACKGROUND OF THE INVENTION

Toggle clamps have been used for some time to hold in their opened channel a holding device for work piece stock. Typically this holding device in the toggle clamp is adjusted vertically or horizontally by loosening two separate nuts located over and under the toggle's elongated central channel where the nuts are on a vertically disposed threaded bolt. The present invention greatly simplifies the adjustment of the vertical holding device within the toggle channel by providing for the separate quick adjustment of the vertical positioning of the holding device relative to the toggle clamp by turning a handle. When the holding device is to be adjusted horizontally, this is accomplished by loosening or tightening, as appropriate, only one nut on the supporting bolt as described herein. Thus, both the vertical and horizontal adjustment of the holding device in the toggle clamp are both simplified from the prior art.

DESCRIPTION OF THE PRIOR ART

Toggle clamps of various descriptions are known in the prior art. For example, in U.S. Pat. No. 3,924,844 to Bachtel, Jr. a lockable toggle clamp to prevent its inadvertent opening when closed is disclosed. The U.S. Pat. No. 4,407,493 to Okolischan describes a self-adjusting toggle clamps having an adjustable bolt 70 which engages a caming surface 36. In the patent (U.S. Pat. No. 4,470,586) to Spencer a machine clamp having a thread thrust screw on one end and a one piece rocker body whose other end engages the work piece is disclosed. Further, the Dykstra reference (U.S. Pat. No. 4,958,813) has a threaded bolt 14 with an internal threaded knob 15, a lower bolt guide 16 and a clamp arm pivotally connected to bolt. While U.S. Pat. No. 4,981,289 to Duval describes a slotted body cam that fits over a threaded bolt with an upper contoured washer and bolt. Additionally, the prior art to Carossino (U.S. Pat. No. 5,080,336) discloses a movable arm 3 that can be immobilized with a work piece bearing skid and a wrench adjustable threaded screw 4 and a screw 31 to engage a slidable block in the worktable. And in U.S. Pat. No. 5,275,391 to Lynn et al. a bench hold-down having a vertically disposed threaded post 12 that engages holes in the bench top with a a hold-down pivotally mounted arm 18 which can be adjusted by knob 34 to apply pressure to the work piece 28 is described. None of these references or any of the other known prior art disclose an internally threaded collar mounted on an externally threaded bolt whose bolt end engages a work piece while the toggle channel is engaged by a washer movable with the collar. An upper handle on one end of a bolt can be used to vertically adjust the holding member while a single nut on one end of the collar engages the upper part of the toggle channel and can be used to horizontally adjust the member with respect to the fixed toggle clamp in its channel all as more further set forth in this specification.

SUMMARY OF THE INVENTION

This invention relates to an adjustable holding device for a work piece held in a conventional toggle clamp that may be adjusted either vertically or horizontally, or both, with respect to the toggle clamp by adjusting either a single handle or single nut, respectively, on a supporting bolt.

It is the primary object of the present invention to provide for the improved vertical adjustable for a holding member associated with a supporting toggle clamp by a single handle.

A secondary object is the simplified horizontal adjustment for the same holding member and toggle clamp combination by a single nut.

Another object is to provide for such a member wherein only one nut need be adjusted to change the position of the holding member relative to the supporting toggle clamp in either a vertical or horizontal direction.

These and other objects and advantages of the present invention will become apparent to readers from a consideration of the ensuing description and the accompanying drawings.

DESCRIPTION OF THE PREFERRED EMBODIMENT

Figure 1:
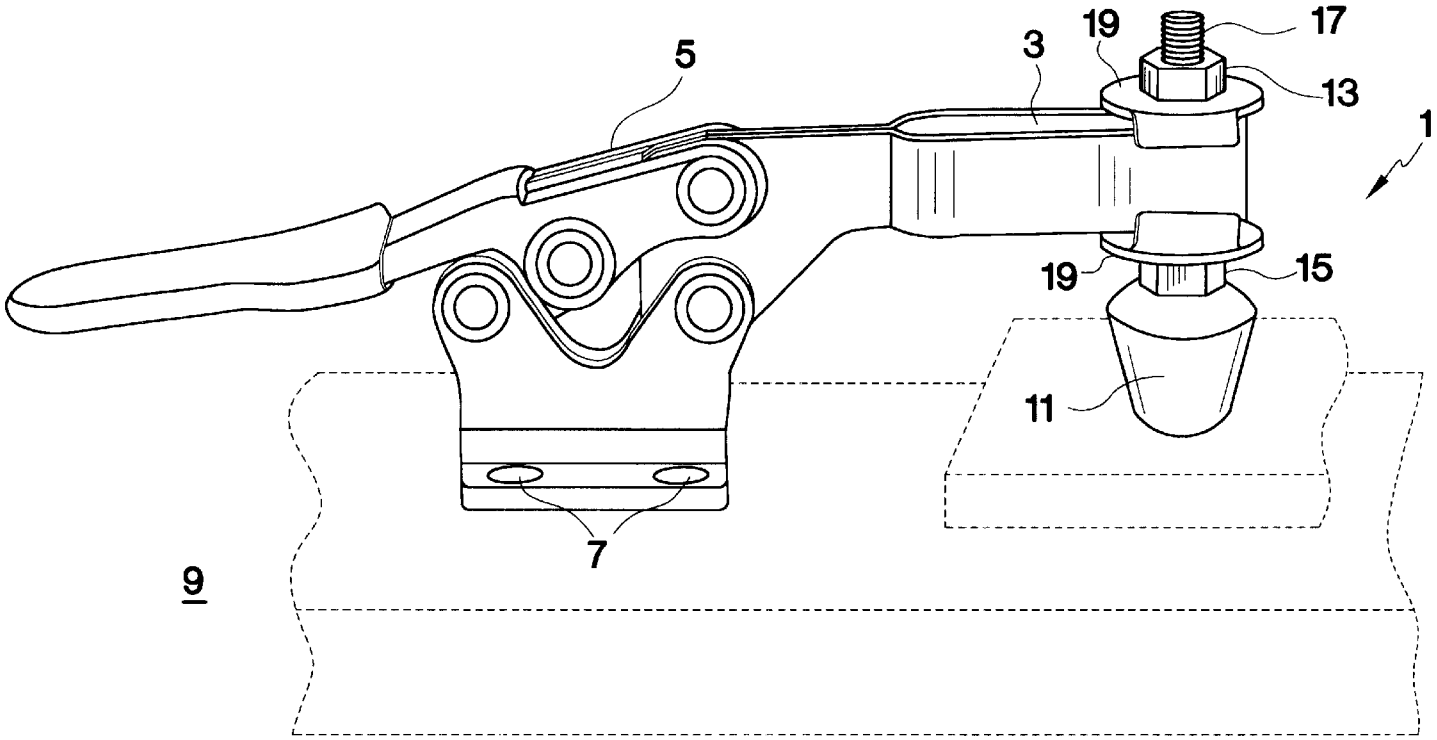
FIG. 1 PRIOR ART
FIG. 1 is a front view of a typical prior art holding member mounted in the elongated channel of a conventional toggle clamp.

FIG. 1 is a front view of a typical prior art holding member 1 mounted in the elongated channel 3 of a conventional toggle clamp 5. Normally the toggle clamp is fixed by screws in the holes 7 to a supporting planar surface 9 such as a horizontally disposed work bench table or a jig. At the lower end of the holding member 1 is a work piece stock engaging member 11, such as a rubber grommet foot, which member bears against the surface of the work piece from above while the work piece's lower surface is supported by lower surface 9. While in this holding position various common workshop operations can be performed on the work piece such as cutting, welding, gluing, grinding, riveting, routing, milling, drilling, reaming, assembling, etc. To vertically adjust the holding member with respect to the fixed toggle clamp and the work piece, two internally threaded bolt mounted nuts 13 and 15, one on the top and one on the bottom, respectively, of the channel 3 that threadly engage the vertically disposed threaded bolt 17 must each first be loosened and then retighted when in the new holding position. Two identical center holed clamp bearing washers 19 mounted on the bolt are typically interposed between the nuts 13 and 15, as shown, to engage the surface of the toggle clamp 5 from above and below its elongated center channel 3. This adjustment operation is relatively slow and tricky in that the lower nut 15 is somewhat difficult to reach to permit the vertical adjust as the vertical thickness of the lower work piece stock, whether metal or wood, varies. Further, when the holding member with bolt 17 is positioned in a different location in the channel, slight horizontal variations between the end of the member 11 and the supporting planar surface 9 may require some added vertical adjustment by the two adjustment nuts on bolt 17. All-in-all such adjustments of the clamp held holding member 1, whether in a vertical or horizontal direction, can be time consuming and often involve some trial and error in the adjustment process by the user.

Figure 2:
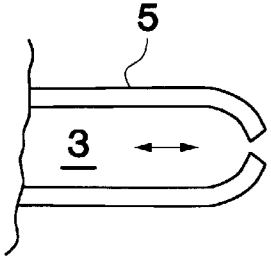
FIG. 2 PRIOR ART
FIG. 2 is an enlarged top view of the unsupported front end of the prior art toggle clamp channel depicted in the FIG. 1 embodiment without the holding member therein.

FIG. 2 is an enlarged top view of the unsupported front end of the prior art toggle clamp channel 3 as depicted in the FIG. 1 embodiment without the work piece holding member 1 therein. The channel 3 arrows depict the horizontal direction the holding member 1 could be moved in the channel of the fixed toggle clamp 5 when one of the two adjustment nuts 13 and 15 are loosened and then retighted. As previously stated, the prior art requires both of the two bolt supported nuts 13 and 15 to be adjusted when the holding member 1 is to be vertically adjusted with respect to the fixed clamp and the work piece.

Figure 3:
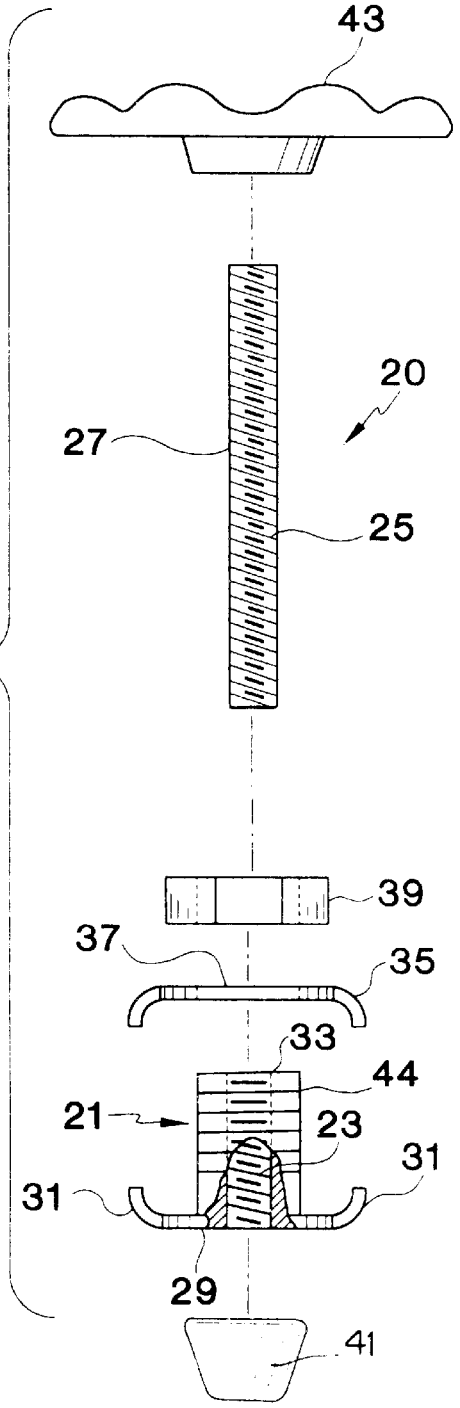
FIG. 3 shows an exploded side view of the present invention's preferred embodiment with a side section of the holding member's collar cut away to shown its internal threads.

FIG. 3 shows an exploded side view of the present invention's preferred embodiment holding member 20 with a side section A of its hollow bore collar 21 cut away to shown its internal central threads 23 which run around the bore along all or part of the bore's length. The pitch of these internal bore collar threads complements the pitch of the engaging external threads 25 on the surface of the common vertically disposed bolt 27. The bolt threads 25 may extend along all or part of the total length of the bolt. Bolt 27 is conventional in general design, like the described bolt 17 of the prior art, the only difference being its complementary outer meshing threads that are specifically chosen to engage the collar's internal threads 23. Forming a part of the one piece unitary structure of the collar 21 is an upwardly facing washer section 29 which extends completely around the collar's main vertical hollow shaft at its lower end and extends outwardly therefrom. The washer's upwardly clamp facing surface 31 is flattened and would appear like an outer ring when viewed from above that is spaced outwardly from the collar's main hollowed centered internally threaded shaft 33. Above the collar is an oppositely facing downwardly folded center holed washer 35 which also has a flattened ringed surface 37 at its edge similar to the ring surface 31 which faces it. The single internally threaded hollow centered adjustment nut 39 is mounted on the upper portion of the external collar threads 44 above the washer 35. The bolt's external threads 25 pass through the nut 39. Also depicted in this figure are the lower work piece stock engaging rubber grommet foot 41 and the upper handle 43 which is threaded mounted to or otherwise fixed to the top of the bolt 27. It is important to note that either grommet member 41 or handle 43 should be removable from the supporting threaded bolt 27 to permit the insertion of the conventional toggle clamp 5 between the two engaging washers 29 and 35. Preferably rubber grommet is internally threaded to permit its removal from the lower external threads of the end of bolt 27. It could of course be held to the bolt's end by force fitting the grommet 41 to the bolt.

Figure 4:
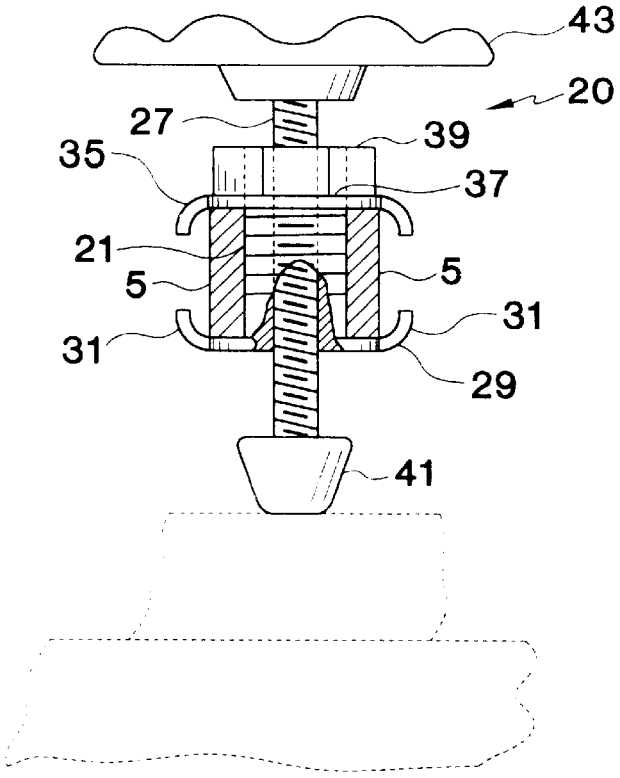
FIG. 4 depicts the FIG. 3 embodiment in its assembled state.

FIG. 4 depicts the FIG. 3 embodiment in its assembled state. The conventional toggle clamp 5 is shown in dotted line format to indicate its vertical placement between the two opposing washers before the upper washer 35 is tightened down to have its flattened surface 37 in engagement therewith while the clamp's lower surface engages the lower washer flattened surface 31. In many cases there are conventional elongated surface indentations running along the top and bottom of the clamp on both sides of the channel which can receive the washer ends 31 and 37. The bolt's threaded shaft is shown passing through the nut 39 and washer 35 while the collar's external upper threads 44 hold the nut 39. Should it be desired to vertically adjust the placement of the rubber grommet 41 with respect to the lower work piece, the handle 43 can be rotated to rise or lower the bolt 27. Horizontal adjustments of the holding member 20 within the toggle channel are accomplished by loosening and moving the member and then tightening the holding nut 39 when at the desired location. Since handle 43 is fixed to the upper end of bolt 27 it rotates in unison therewith to permit the bolt to move up or down, as is the case, within the hollow bore collar 21

Figure 5:
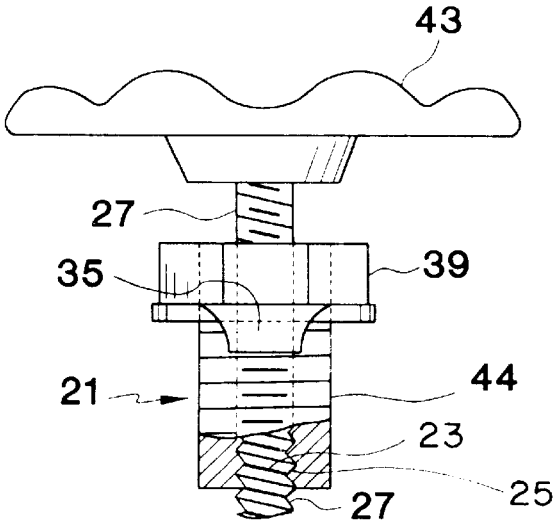
FIG. 5 depicts the upper section of the FIG. 3 embodiment in its assembled state. with a section of the collar cut away.

FIG. 5 depicts the upper section of the FIG. 3 embodiment in its assembled state with a section of the collar cut away. In the cut away collar portion the bolt 27 is shown extending down into the collar's bore with its external bolt threads 25 meshing with the internal bore collar threads 23. The bolt 27 is slightly smaller in outside diameter than the diameter of the central bore in washer 35 and the threaded central bore in nut 39 to allow it to freely pass through both of these bores. The internal threads of nut 39 engage the external threads on collar 44 while the nut's surface bears against the surface of upper washer 35. Thus, by tightening down on the threads 44 the nut 39 can be used to tighten its associated washer 35 against the toggle clamp's upper channel.

It should be clear that the terms horizontal and vertical are relative to the described embodiment. Thus, the horizontally disposed conventional clamp 5 and vertically disposed bolt holding member 20 could be oriented in opposite directions or any angular relationship in between as long as their relative orientation is maintained.

The toggle clamp is conventional in design and may assume many different shapes such as the RED HEAD toggle action clamps manufactured by Case-Maul Clamps, Inc., Norwalk, Ohio. Accuracy and strength are essential in the design of such toggle clamps since the performance of precision operations on the work piece stock, especially metal stock, requires no less. A toggle clamp handle (not shown) may be used to cause the width of the toggle's channel to compress when the handle is depressed to assist in holding the inserted holding member 20 at the desired horizontal position relative to the clamp along the channel's length. The lower rubber grommet may be replaced by a flatten metal nut, or pivotally mounted work piece engaging metallic member, or any other conventional work piece engaging end located at the bolt's 27 end. Whatever, the type of conventional toggle channel used with the holding member 20, it is essential that it have some type of holding member channel along its length to receive the collar 21 with its internal bolt 27 while the upper and lower channel surfaces are engaged by the two opposite washer's surfaces. Almost any type of known conventional toggle clamp may be used even those whose channel is restricted in length to provide for little or no horizontal adjustment of the holding member. Thus, no modifications are contemplated to the majority of conventional toggle clamps insuring their ready and easy use with the invention's preferred embodiment's holding member 20.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A holding device for use with a toggle clamp having an opened channel comprising:

a collar with an external surface having a length, a first end and a second end, said collar having an internal bore surface extending substantially the entire length of the collar, said collar having bore surface retaining elements extending at least partially along said internal bore surface and at least partially along the external surface of the collar, said collar having an enlarged first clamp bearing surface extending outwardly from the first end of the collar;

an elongated bolt having a length, a first end and a second end, said bolt having exterior surface retaining elements at least partially along the length of the bolt, said bolt surface retaining elements being adapted to engage the bore surface retaining elements of the collar and to extend from the first end and the second end of the collar;

a second clamp bearing surface member mountable on the second end of the collar, said second clamp bearing surface and said first clamp bearing surface being mountable on opposite channel sides of a toggle clamp; and a collar engaging member having surface retaining elements which can engage the external surface retaining elements of the collar, said collar engaging member being mounted on the second collar end adjacent said second clamp bearing surface to retain the second clamp bearing surface member to the collar.

2. The holding device of claim 1, wherein said bolt and collar surface retaining elements are threaded surfaces.

3. The holding device of claim 1, wherein said collar's first clamp bearing surface is formed as a single unit integral with said collar.

4. The holding device of claim 1, also including a hand operated member fixedly mounted near the first end of said bolt and extending outwardly from the bolt for turning said bolt.

5. The holding device of claim 4 also including a soft deformable work piece engaging member located on said bolt second end opposite said hand operated member.

6. The holding device of claim 4, wherein said first bearing member and said second collar bearing member are both washers having bent end surfaces, said bent end surfaces of said first bearing member facings towards the bent end surfaces of said second collar bearing member when said collar is mounted in the toggle channel on the bolt with each of said washers extending outwardly from the opened toggle channel.

7. The holding device of claim 1, wherein said collar engaging member is a nut with an internally threaded central bore whose bore threads can engage said external collar retaining members.

8. A combined work piece holding device and an opened toggle clamp comprising in combination:

a toggle clamp having two sides with an opened channel between the two sides;

a collar with an external surface having a length, a first end and a second end, said collar having an internal bore surface extending substantially the entire length of the collar, said collar having bore surface retaining elements extending at least partially along said internal bore surface and at least partially along the external surface of the collar, said collar having an enlarged first clamp bearing surface extending outwardly from the first end of the collar;

an elongated bolt having a length, a first end and a second end, said bolt having exterior surface retaining elements at least partially along the length of the bolt, said bolt surface retaining elements being adapted to engage the bore surface retaining elements of the collar and to extend from the first end and the second end of the collar;

a second clamp bearing surface member mountable on the second end of the collar, said second clamp bearing surface and said first clamp bearing surface being mountable on opposite ends of the sides of said toggle clamp; and a collar engaging member having surface retaining elements which can engage the external surface retaining elements of the collar, said collar engaging member being mounted on the second collar end adjacent said second clamp bearing surface to retain the second clamp bearing surface member to the collar and to the clamp.

9. The combination of claim 8, wherein said bolt and collar surface retaining elements are threaded surfaces.

10. The combination of claim 8, wherein said collar's first clamp bearing surface is formed as a single unit integral with said collar.

11. The combination of claim 8, also including a hand operated member fixedly mounted near the first end of said bolt and extending outwardly from the bolt for turning said bolt.

12. The combination of claim 11, also including a soft deformable work piece engaging member located on said second bolt end opposite said hand operated member.

13. The combination of claim 11, wherein said first bearing member and said second collar bearing member are both washers having bent end surfaces, said bent end surfaces of said first bearing member facing towards the bent end surfaces of said second collar bearing member when said collar is mounted in the channel on the bolt with each of said washers extending outwardly from the opened toggle channel.

14. The combination of claim 8, wherein said collar engaging member is a nut with an internally threaded central bore whose bore threads can engage said external collar retaining members.

* * * * *